US006314667B1

(12) United States Patent
Rife et al.

(10) Patent No.: US 6,314,667 B1
(45) Date of Patent: Nov. 13, 2001

(54) BELT DRIVE WITH AUTOMATIC BELT TENSIONING

(75) Inventors: Nathan J. Rife, Hartland; Joseph J. Colwell, Butler, both of WI (US)

(73) Assignee: Harnischfeger Technologies, Inc., Wilmington, DE (US)

( * ) Notice: Subject to any disclaimer, the term of this patent is extended or adjusted under 35 U.S.C. 154(b) by 0 days.

(21) Appl. No.: 09/598,801

(22) Filed: Jun. 21, 2000

(51) Int. Cl.[7] ..... E02F 3/58
(52) U.S. Cl. ..... 37/397; 414/690
(58) Field of Search ..... 37/394, 395, 396, 37/397, 399, 401; 414/685, 695.6, 709, 718, 690

(56) References Cited

U.S. PATENT DOCUMENTS 3,580,405 5/1971 Siegel et al. .
4,024,969 * 5/1977 Hedeen .
5,151,075 * 9/1992 Beaulleu et al. .
5,469,647 * 11/1995 Profio .
5,529,553 * 6/1996 Finlayson .

* cited by examiner

*Primary Examiner*—Victor Batson
(74) *Attorney, Agent, or Firm*—James Earl Lowe, Jr.

(57) ABSTRACT

A belt drive including a first belt sheave having a center, the first belt sheave having a center, the first belt sheave being pivotally mounted on a member, and a motor base pivotally connected at one end to the member. The belt drive further includes a motor mounted on the other end of the motor base, and a second belt sheave rotatable by the motor. A belt is trained around the first and the second belt sheaves. The belt also includes an adjusting mechanism extending between the motor base and the member for fixing the position of the motor base relative to the member and for fixing the center to center distance between the first and the second belt sheaves. The adjusting mechanism comprises a cylinder assembly including a cylinder housing and a piston rod extending from the housing and being extendable from and retractable into the housing, with the housing being connected to the member and the piston rod being connected to the motor base. The adjusting mechanism further comprises a rod brake mounted on the piston rod, adjacent the cylinder housing with the piston rod extending through the rod brake, for releasably securing the piston rod to the cylinder housing to prevent the retraction of the piston rod into the cylinder.

10 Claims, 3 Drawing Sheets

BELT DRIVE WITH AUTOMATIC BELT TENSIONING

BACKGROUND OF THE INVENTION

The invention pertains generally to a belt drive including two belt sheaves, a belt trained around the sheaves, and means for adjusting the tension of the belt. More particularly, this invention pertains to power shovels having a boom on which a dipper stick is mounted for pivoting about and sliding therewith, the dipper stick having a dipper at its lower end. The dipper stick is mounted for movement relative to the boom so that the dipper can be moved into and out of the bank by a crowd drive. The crowd drive works in conjunction with the hoist motion (which raises and lowers the dipper) to dig and position the resulting load of excavated material.

The crowd drive is a heavily shock loaded drive. Upon hitting a hard toe (an area not as well fragmented by a shot blast) in the bank the load on the drive system can dramatically increase. For this reason, power from a crowd drive crowd motor is typically transmitted to the gear case via two large belts consisting each of five 8V belts banded together. The purpose of the belts is to absorb the shock loads when they occur. Properly tensioned belts will slip on a sheave before they break, and limit the impact loading on the entire gear train.

The loading on this drive is nearly fully reversing, meaning that the loading is nearly the same in both crowd and retract. Because of this, the system needs to be able to handle operating loads in both directions.

There exists a need to increase the accuracy of belt tensioning and reduce the amount of time required to perform the work. Properly tensioned belts are critical to the life of the belts and the performance of the mining shovel. All past means of tensioning belts have required manual labor. Because of this, belt tensioning can mean at least one hour or more of machine downtime. This is very costly to the customer (roughly $15,000 to $20,000 in lost ore production). Most importantly, there always remained a potential for human error. The pressure gage used to set the belt tension could only be read to the nearest 50 psi. The accuracy of the settings has always been a concern.

Currently the belts, when new, are overtensioned beyond what is needed because new belts stretch very quickly. This lengthens the interval for when the first retensioning needs to occur. The current system for knowing when to retension is to listen for the belts to squeal when they slip excessively. This is a very unreliable process on current machines because, with acoustic insulation in the operator's station, he may not hear it. This requires checking by time rather than by sound. If allowed to continue to operate when slipping, belts will glaze such that normal tensioning will no longer prevent slippage. Further overtensioning of the belts can lead to shaft breakage or bearing failures.

SUMMARY OF THE INVENTION

This invention is in the form of a belt drive including a first belt sheave having a center, the first belt sheave being pivotally mounted on a member, and a motor base pivotally connected at one end to the member. The belt drive further includes a motor mounted on the other end of the motor base, and a second belt sheave rotatable by the motor. A belt is trained around the first and the second belt sheaves. The belt also includes an adjusting mechanism extending between the motor base and the member for fixing the position of the motor base relative to the member and for fixing the center to center distance between the first and the second belt sheaves. The adjusting mechanism comprises a cylinder assembly including a cylinder housing and a piston rod extending from the housing and being extendable from and retractable into the housing, with the housing being connected to the member and the piston rod being connected to the motor base. The adjusting mechanism further comprises a rod brake mounted on the piston rod, adjacent the cylinder housing with the piston rod extending through the rod brake, for releasably securing the piston rod to the cylinder housing to prevent the retraction of the piston rod into the cylinder.

Still more particularly, this invention comprises a power shovel including a crowd mechanism with the above belt drive.

This invention is designed to automate the process of tensioning belts by supplying pressure to a hydraulic cylinder to set belt tension and then locking the center to center distance between the belt sheaves so the tension is maintained during operation of the drive assembly. The actual tensioning of the drive is done through the programming of a PLC so that it is virtually a maintenance free means of tensioning the belts.

The ability to tension belt reliably with an automated system which will be more accurate, require less time and resources, and provide for a timely tension cycle set by the PLC, not maintenance schedules. This will result in improved life of belt and of crowd drive mating components.

Figure 1:
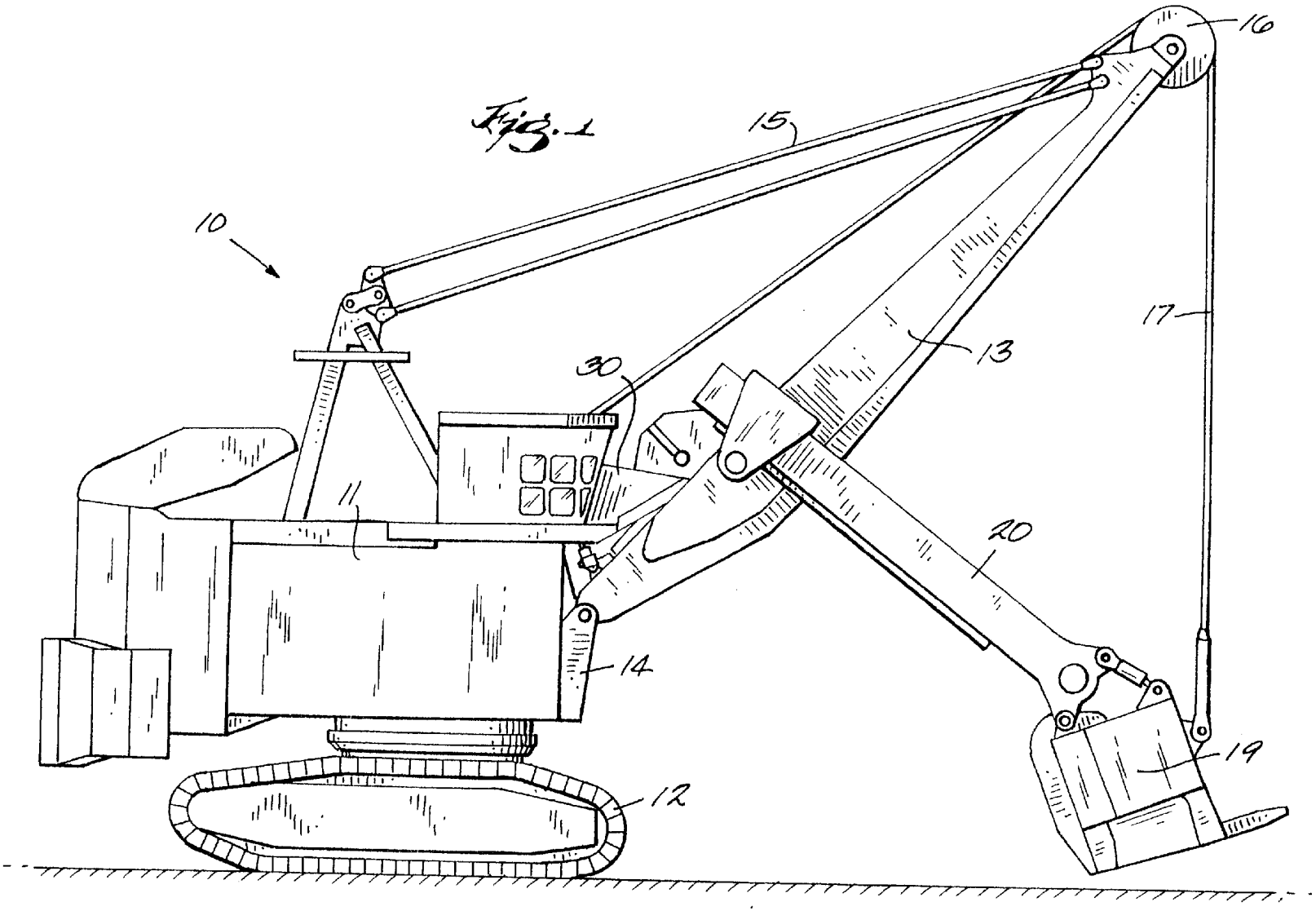
FIG. 1 is a side elevational view of a power shovel embodying the present invention.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof, as well as additional items. Use of "consisting of" and variations thereof as used herein is meant to encompass only the items listed thereafter and equivalents thereof.

DESCRIPTION OF THE PREFERRED EMBODIMENT

The general organization of a power shovel 10 embodying the present invention is shown in FIG. 1 and includes a revolvable upper frame 1 mounted on a ground engaging means 12, which means has been shown as endless tracks. A boom 13 extends from the upper revolvable part from its mounting 14. The boom 13 is suspended by the conventional cables 15 and has a large sheave 16 at its outer end. A hoist cable 17 extends over the sheave from a winch drum (not shown) and is fastened to the dipper 19. The dipper 19 is fixed to the end of a dipper stick 20, the latter in turn being mounted for movement on and relative to the boom 13. By extending the dipper stick 20 relative to the boom 13, a crowding action of the dipper 19 into the material (not shown) is accomplished.

As is conventional, and as is more fully described in Siegel U.S. Pat. No. 3,580,405 incorporated herein by reference, the shovel 10 includes a crowd drive mechanism 30 comprising a multiple V-belt drive 32 for transmitting power from an electric motor 34 to a gear reduction unit (not shown) that in turn drives the shipper shaft (not shown) of the dipper stick. When the shipper shaft rotates, the dipper stick 20 moves into or out of the bank, as is well known in the art.

The gear reduction unit includes a shaft (not shown) on the end of which is a multiple V-pulley or first belt sheave 35. An electric motor 40 is also mounted on the boom 13 and it has a multiple V-pulley or second belt sheave 41 (FIG. 5) fixed to its shaft 42. An endless multiple V-belt 53 is trained over the pulleys 35 and 41.

Figure 2:
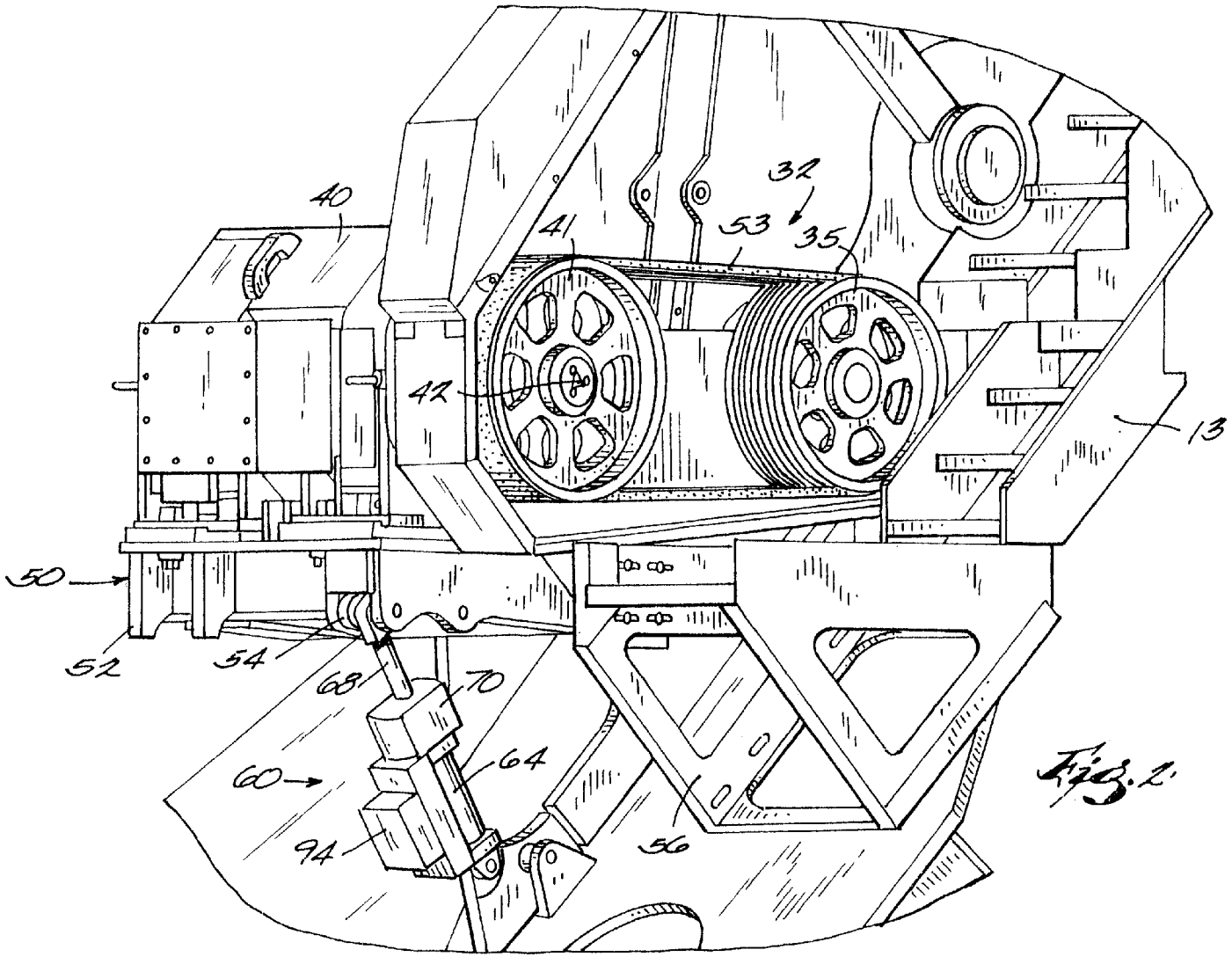
FIG. 2 is a perspective view of the boom shown in FIG. 1, and showing the drive mechanism thereon.

More particularly, the electric motor 40 is secured to a base 50 which in turn has two depending, bifurcated brackets 52 and 54 (FIG. 2) which are pivotally mounted to upstanding members 55 (not shown) and 56, respectively, by means of pivot pins (not shown). Adjusting means 60 is provided for tilting the motor 40 and its base 50 about the pins, in one direction or another, so as to vary the amount of tension in the unitized, endless multiple V-belt 33. This adjusting means 60 extends between the motor base 50 and the boom 13 for fixing the position of the motor base 50 relative to the boom 13 and for fixing the center to center distance between the first 35 and the second 41 belt sheaves.

More particularly, the adjusting means 60 comprises a cylinder assembly including a cylinder housing 64 and a piston rod 68 extending from the housing 64 and extendable from and retractable into the housing 64. The housing 64 is pivotally connected to the boom 13 and the piston rod 68 is pivotally connected to the motor base 50. In the preferred embodiment, a hydraulic cylinder is used. In other less preferred embodiments, an air fluid cylinder could be used.

The adjusting means 60 further includes a rod brake 70 mounted on the piston rod 68, adjacent to the cylinder housing 64 with the piston rod 68 extending through the rod brake 70, for releasably securing the piston rod 68 to the cylinder housing 64 to prevent the retraction of the piston rod 68 into the cylinder housing 64. More particularly, the rod brake 70 is attached to the end of the cylinder housing 64. Further, as shown schematically in FIG. 3, the hydraulic brake 70 is a large spring set/hydraulic released brake that takes the entire load during digging and maintains the center to center distance set during the tensioning cycle. It is released only during tensioning of the belts so that the rod is free to move.

Figure 3:
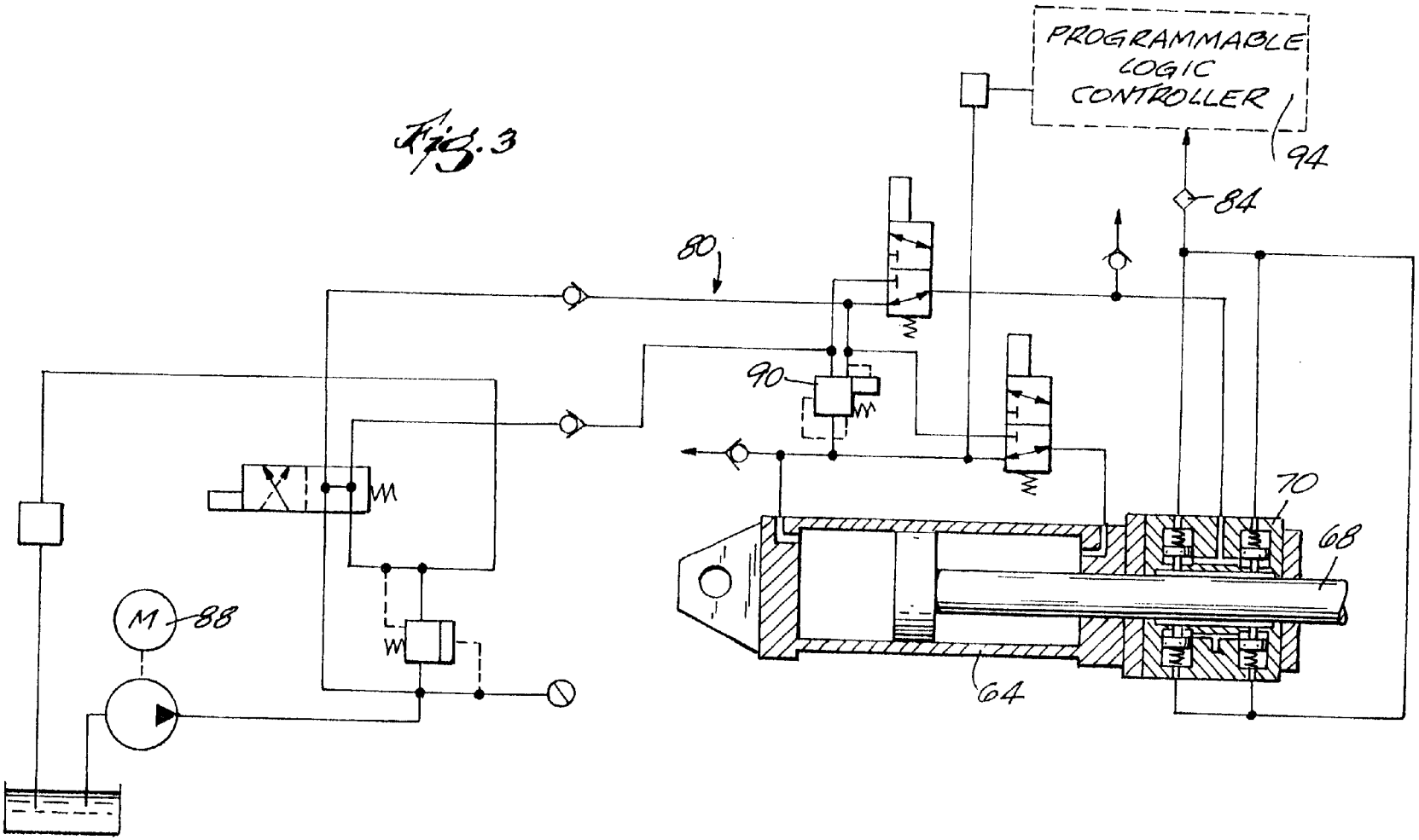
FIG. 3 is a hydraulic schematic of the mechanism used to automatically tension the drive mechanism belts.

As shown in FIG. 3, the adjusting means 60 further includes a hydraulic fluid system 80 including means 84 for measuring the hydraulic fluid pressure within the cylinder assembly, and pump means in the form of a hydraulic pump 88 for extending or retracting the piston rod 68 from the cylinder housing 64 when the rod brake 70 releases the piston rod 68. The hydraulic pump 88 (see FIG. 3): provides the necessary line pressure to release the hydraulic brake 70 and provide a proportional valve 90 on the cylinder with enough pressure to adjust the belt tension.

The hydraulic fluid system 80 also includes a programmable logic controller 94 (PLC) comprising means for operating the rod brake 70 to release the piston rod 68, means for responding to the measured fluid pressure in the cylinder assembly 60 to cause the extension or retraction of the piston rod 68 from the cylinder housing 64 by the pump means 88, and means for operating the rod brake 70 to secure the piston rod 68 to the cylinder housing 64.

In the preferred embodiment, the programmable logic controller 94 further includes means for determining when to adjust the belt tension. More particularly, the PLC is set to check the belt tension at machine startup periodically after a predetermined number of working hours, or at the operator's option.

In operation, the hydraulic cylinder 60 sets belt tension by supplying a pressure to balance the load placed on the belts 53 by the weight of the motor 40 and motor base 50. The cylinder was designed to be large enough to take the shock loading of the drive during digging, while maintaining adjustability and accuracy in setting belt tension.

A remote control box (not shown) is located on the side of the operators cab to allow for a maintenance crew to manually actuate the hydraulic cylinder and system to change out the belts when necessary. Activation of the remote box indicates that new belts have been installed.

The retensioning interval is controlled via the PLC. This interval varies with new belts to account for initial stretch and seating of the belts into the grooves of the sheaves. When belts are changed (as indicated by activation of the remote box), the PLC will tension them more frequently at first and then gradually increase the interval as the need for retensioning decreases.

Tensioning can only be done while all the motion brakes are set. The best time for this is during machine start-up. The PLC uses the machine hours timer to know when the belts need to be tensioned, and then during the next available start-up, the belts are re-tensioned.

Through the PLC, the tensioning process is fully automated. During belt tensioning, the PLC will turn on the pump so that system pressure is achieved and energize the valves in the hydraulic circuit so the brake is released and the proper tensioning pressures are achieved.

The tension of the belts 53 extending between the first 35 and second 41 belt sheaves determines the resulting fluid pressure in the hydraulic cylinder 60. In other words, the belt tension results in a given pull on the first belt sheave 35 by the second belt sheave 41 and the belts 53. This in turn results in a force on the hydraulic cylinder 60 by the motor 40 and motor base 50. Thus by measuring the fluid pressure in the hydraulic cylinder 60, the belt tension can be determined.

The proportional valve sets the belt tension by adjusting the fluid pressure in the cylinder 60 to the value stored in the PLC. This value was previously determined to be the correct value for the desired belt tension. The proportional valve is controlled to supply the pre-determined pressure to the hydraulic cylinder via the hydraulic pump.

The PLC also controls whether or not tensioning can occur. The program checks to make sure the machine is level and all motion brakes are set. If for instance, the machine is not level, tensioning will be postponed until the next interval.

With the new system, belts can be tensioned more frequently to avoid these problems because there is no labor or downtime involved to retension the belts. Belts don't need to be overtensioned when new also. As such, the new system not only reduces labor to adjust the belts; it provides more accurate belt tension, which reduces component failures.

One of the challenges faced in developing this system was the need for a fixed center to center distance during operation of the mining shovel. We knew that the tensioning system must not have any possibility of moving during operation. All tensioning needs to be done while the shovel is shut down" and that tensioning must remain fixed during operation of the shovel.

This eliminated numerous options that would try to maintain a constant tension (even during operation of the mining shovel). This would be unacceptable since the tensioning device would constantly be trying to compensate for normal fluctuations due to the rigorous digging environment. As mentioned earlier, the loading on this drive strut is fully reversing meaning it sees the same loading in both tension and compression. The problem faced was not one of fixed pressure to maintain a correlating belt tension, but rather fixed center distance after setting belt tension for normal operation.

What is claimed is:

1. A belt drive including:

a first belt sheave having a center, the first belt sheave being pivotally mounted on a member, a motor base pivotally connected at one end to said member, a motor mounted on the other end of the motor base, a second belt sheave rotatable by said motor, a belt trained around said first and said second belt sheaves, and adjusting means extending between said motor base and said member for fixing the position of said motor base relative to said member and for fixing the center to center distance between said first and said second belt sheaves, said means comprising a cylinder assembly including a cylinder housing and a piston rod extending from the housing and being extendable from and retractable into said housing, with said housing being connected to said member and said piston rod being connected to said motor base, and a rod brake means mounted on the piston rod, adjacent the cylinder housing with said piston rod extending through said rod brake means, for releasably securing said piston rod to said cylinder housing to prevent the retraction of said piston rod into said cylinder housing.

2. A belt drive in accordance with claim 1 wherein said cylinder assembly is a hydraulic fluid assembly.

3. A belt drive in accordance with claim 1 and further including means for measuring the hydraulic fluid pressure within said cylinder assembly, and pump means for extending or retracting said piston rod from said cylinder housing when said rod brake releases said piston rod.

4. A belt drive in accordance with claim 1 and further including a programmable logic controller comprising means for operating said rod brake means, to release said piston rod, means for responding to said measured fluid pressure in said cylinder assembly to cause the extension or retraction of said piston rod from said cylinder housing by said pump means, and means for operating said rod brake to secure said piston rod to said cylinder housing.

5. A belt drive in accordance with claim 4 and wherein said programmable logic controller further includes means for determining when to adjust the belt tension.

6. A power shovel including:

a ground engaging means, revolvable upper frame mounted on said ground engaging means, a boom extending from said revolvable upper frame, a large sheave at the boom's outer end, a dipper, a hoist cable extending over said sheave and fastened to said dipper, a dipper stick being mounted for movement on and relative to the boom, said dipper being fixed to the end of a dipper stick, means for driving the dipper stick outwardly, and also for retracting it inwardly, said means for driving comprising a belt drive including:

a first belt sheave having a center, the first belt sheave being pivotally mounted on a boom, a motor base pivotally connected at one end to said boom, a motor mounted on the other end of the motor base, a second belt sheave rotatable by said motor, a belt trained around said first and said second belt sheaves, and adjusting means extending between said motor base and said boom for fixing the position of said motor base relative to said boom and for fixing the center to center distance between said first and said second belt sheaves, said means comprising a cylinder assembly including a cylinder housing and a piston rod extending from the housing and being extendable from and retractable into said housing, with said housing being connected to said boom and said piston rod being connected to said motor base, and a rod brake means mounted on the piston rod, adjacent the cylinder housing with said piston rod extending through said rod brake means, for releasably securing said piston rod to said cylinder housing to prevent the retraction of said piston rod into said cylinders housing.

7. A power shovel in accordance with claim 6 wherein said cylinder assembly is a hydraulic fluid assembly.

8. A power shovel in accordance with claim 6 and further including means for measuring the hydraulic fluid pressure within said cylinder assembly, and pump means for extending or retracting said piston rod from said cylinder housing when said rod brake releases said piston rod.

9. A power shovel in accordance with claim 6 and further including a programmable logic controller comprising means for operating said rod brake to release said piston rod, means for responding to said measured fluid pressure in said cylinder assembly to cause the extension or retraction of said piston rod from said cylinder housing by said pump means, and means for operating said rod brake to secure said piston rod to said cylinder housing.

10. A power shovel in accordance with claim 9 and wherein said programmable logic controller further includes means for determining when to adjust the belt tension.

* * * * *